US005119742A

United States Patent [19]

Simmie

[11] Patent Number: 5,119,742

[45] Date of Patent: Jun. 9, 1992

[54] APPARATUS FOR PROVIDING A MOUNTABLE WORKSURFACE FOR A COMPUTER MOUSE

[76] Inventor: Odell L. Simmie, 111 Tremaine Avenue, Regina, Saskatchewan, Canada, S4R 6N7

[21] Appl. No.: 673,069

[22] Filed: Mar. 21, 1991

[51] Int. Cl.[5] ..... A47B 5/00

[52] U.S. Cl. ..... 108/152; 248/214; 248/231.4

[58] Field of Search ..... 108/46, 47, 42, 152; 248/214, 215, 225.31, 231.4, 918

[56] References Cited

U.S. PATENT DOCUMENTS

| | | | |
|---|---|---|---|
| 1,411,572 | 4/1922 | Kramer | 248/231.4 |
| 2,291,870 | 8/1942 | Blair et al. | 248/231.4 |
| 2,558,323 | 6/1951 | Strun | 248/231.4 X |
| 2,620,082 | 12/1952 | Harmon | 248/231.4 X |
| 2,686,702 | 8/1954 | Ventrice | 108/152 X |
| 2,710,051 | 6/1955 | Greenberg | 108/152 X |
| 4,562,987 | 1/1986 | Leeds et al. | 248/918 X |
| 4,776,284 | 10/1988 | McIntosh . | |
| 4,794,675 | 1/1989 | Bisconti | 248/213.4 X |
| 4,863,124 | 9/1989 | Ball et al. . | |
| 4,913,387 | 4/1990 | Tice . | |
| 4,973,176 | 11/1990 | Dietrich . | |

*Primary Examiner*—Peter A. Aschenbrenner

[57] ABSTRACT

Apparatus to provide a mountable worksurface for the operation of a computer mouse adapted to be attached to a computer workarea comprising a first clamp element slidably attached to a substantially flat rectangular mouse worksurface and locking means to lock said first clamp element at a predetermined position in relation to said mouse worksurface whereby said first clamp element is adapted to clamp the upper portion of a computer workarea with said mouse worksurface positioned horizontally at a selected off-set to the computer workarea; a pair of extension arms attached to and extending below opposing sides of said mouse worksurface, adjacent to the side incorporating said first clamp element; each extension arm provided with a channel for slidably receiving a second clamp element, said second clamp element adapted to be positioned to engage the underside of said computer workarea inward from the edge thereof, and locking means to lock each said second clamp element to its corresponding extension arm at a predetermined position whereby said computer mouse worksurface will be rigidly attached to said computer workarea providing a mouse worksurface position above or below said computer workarea.

7 Claims, 7 Drawing Sheets

APPARATUS FOR PROVIDING A MOUNTABLE WORKSURFACE FOR A COMPUTER MOUSE

BACKGROUND OF THE INVENTION

With the evermore common deployment of computer workstations and personal computers using a mouse input device, the work space of existing office furniture stock is increasingly crowded by the existing paper flows and added presence of the computer equipment on existing office furniture. To avoid wholesale abandonment of existing office furniture yet provide a work space useful to the operation of computer equipment it is often necessary to purchase additional furniture to provide worksurfaces to deploy the computer equipment on. This is particularly true where the computer system uses a mouse input device in addition to the keyboard found in such personal computer and computer workstation systems. Frequently office work space does not provide sufficient floor area to permit the incorporation of additional pieces of office furniture.

To avoid the purchase of additional office furniture, and all of the concomitant problems associated therewith, it has, in the past, been proposed to provide various additions to existing worksurfaces thereof to accommodate the elements of a workstation computer system. For example, U.S. Pat. No. 4,776,284 to McIntosh describes a retractable keyboard platform having a swing-link extension that attaches the platform to the workstation desktop such that the keyboard may be positioned on the platform. When in use, the platform swings out from under the desktop and locks into position at the front of the desktop that is supporting the computer. The keyboard may then be used by the operator to provide input to the computer. When use of the computer is completed, the platform and keyboard resting thereon is swung into storage under the desktop until the next time it is needed. Such a platform is not ideally suited to additionally incorporating a portion of space suitable for operation of a computer mouse input device as a mouse requires an operating space of approximately 100 square inches, measuring approximately 10 inches by 10 inches. Thus to make such a platform useful for additionally operating the mouse device would require extending the platform surface laterally by about 10 inches making its manufacture more costly. Moreover, the keyboard trays are typically narrower than 10 inches across their girth. To adequately provide a mouse work area at either end of an extended keyboard tray would additionally require the tray itself to be made broader than is ideally required for a tray which is used for a keyboard alone.

The mouse tray apparatus disclosed herein eliminates the need for a expensive replacement of existing work space furniture or the need to provide additional office furniture to provide extra worksurfaces for operation of a mouse input device for the computer system.

In one of its aspects, the invention provides apparatus to provide a mountable worksurface for the operation of a computer mouse adapted to be attached to a computer workarea comprising a first clamp element slidably attached to a substantially flat rectangular mouse worksurface and locking means to lock said first clamp element at a predetermined position in relation to said mouse worksurface whereby said first clamp element is adapted to clamp the upper portion of a computer workarea with said mouse worksurface positioned horizontally at a selected off-set to the computer workarea; a pair of extension arms attached to and extending below opposing sides of said mouse worksurface, adjacent to the side incorporating said first clamp element; each extension arm provided with a channel for slidably receiving a second clamp element, said second clamp element adapted to be positioned to engage the underside of said computer workarea inward from the edge thereof, and locking means to lock each said second clamp element to its corresponding extension arm at a predetermined position whereby said computer mouse worksurface will be rigidly attached to said computer workarea providing a mouse worksurface positioned above or below said computer workarea.

DETAILED DESCRIPTION OF THE PREFERRED EMBODIMENT

Figure 1:
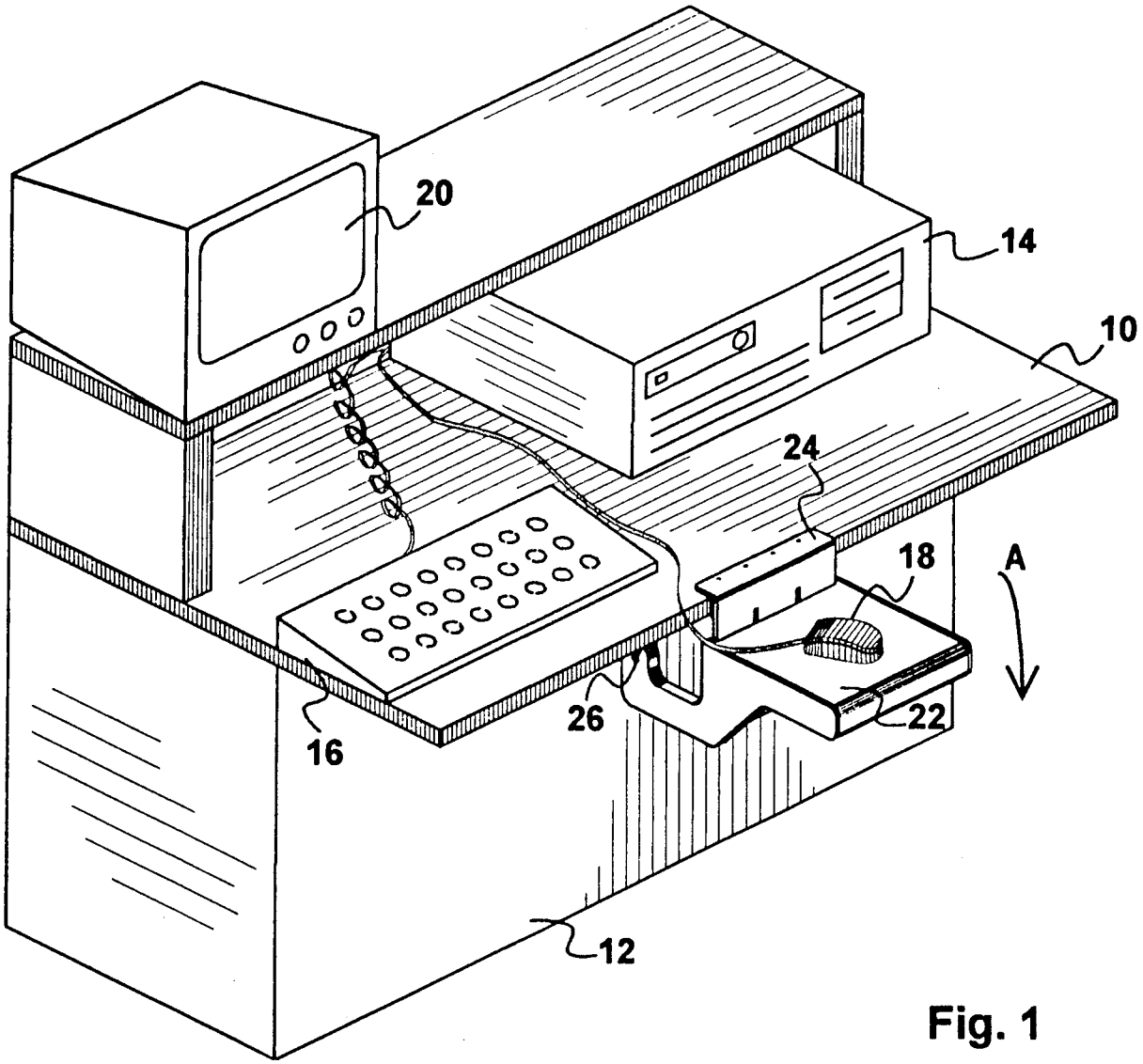
FIG. 1 is a perspective view of a computer work area fitted with a mouse worksurface in accordance with the present invention.

When referring to the drawings, it should be noted that like features of the invention are referenced by like numerals throughout the figures.

Referring to FIG. 1 which shows a perspective view of a computer workarea 10 comprising a desk having a personal computer 14 resting thereon. Input is provided to the computer 14 by means of a keyboard 16 and a computer input mouse 18. Output from the computer to confirm input from the mouse or keyboard is conveyed back to the operator of the computer by means of images generated by the computer on monitor 20. Various other configurations of computer systems are in use today, such as laptop computers, and the given configuration is intended simply to show a typical configuration that employs a mouse 18 as an input device. The mouse is shown positioned on a mouse worksurface 22 that is the preferred embodiment of the invention described herein. Mouse worksurface 22 is clamped to the computer workarea 10 by means of a first clamp element 24 that engages the upper surface of a portion of workarea 10. Providing a level mouse worksurface 22 to work on is maintained by a second clamp means 26 which is barely visible in this view but will be clearly shown with reference to FIG. 2. To mount the mouse tray on a workarea such as desktop 10, the mouse tray assembly is moved toward the desktop in a tilted orientation to allow second clamp element 26 to clear the lower obstacles of the desktop. Once the first clamp element 24 is positioned over the desktop at the desired location the entire mouse tray assembly is rotated in direction of arrow "A" until the second clamp element comes into contact with the underside of desktop 10. Once the computer workarea has been clamped between the first and second clamp elements as described above, the compression on the computer workarea applied by the first and second clamp elements is maintained by the weight of the mouse worksurface 22 which causes an angular moment about first clamp element 24 that is counter-acted by the contact of second clamp element 26 on the underside of desktop 10. To provide a solid feel for someone operating a mouse 18 on the mouse worksurface 22, it is preferable to have second clamp element 26 contact the underside of the desktop 10 several inches behind the pivoting contact of first clamp element 24. If second clamp element 26 contacts the underside of desktop 10 too close to the contact made by first clamp element 24 then the second clamp element 26 will be poorly positioned to counteract the angular moments introduced when the mouse worksurface 22 is being used (e.g. when the mouse buttons are depressed or clicked) and the tray will have a wiggly feel to the person operating the mouse 18.

Figure 1A:
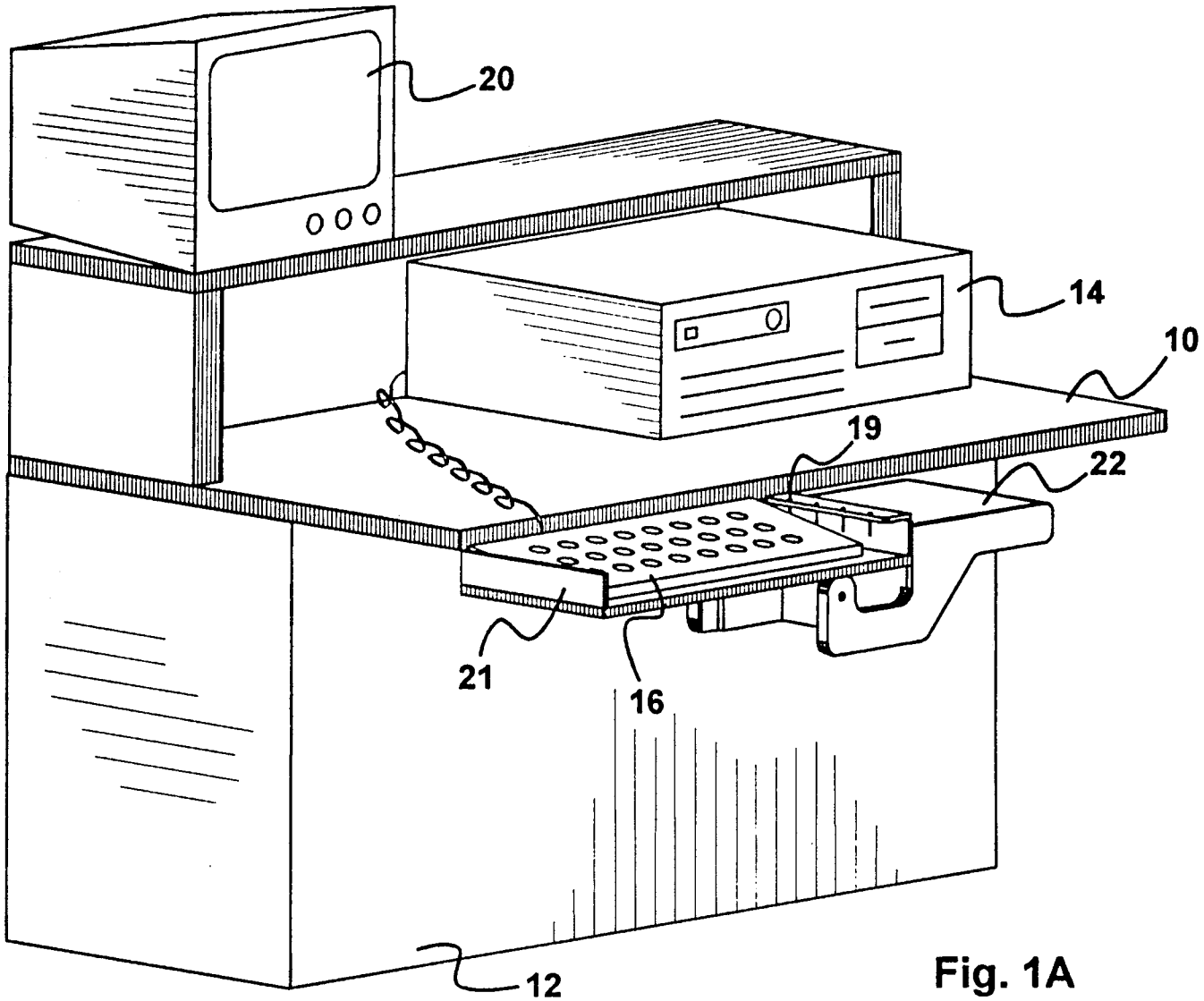
FIG. 1A is a perspective view of a keyboard tray fitted with a mouse worksurface in accordance with the present invention.
Figure 2:
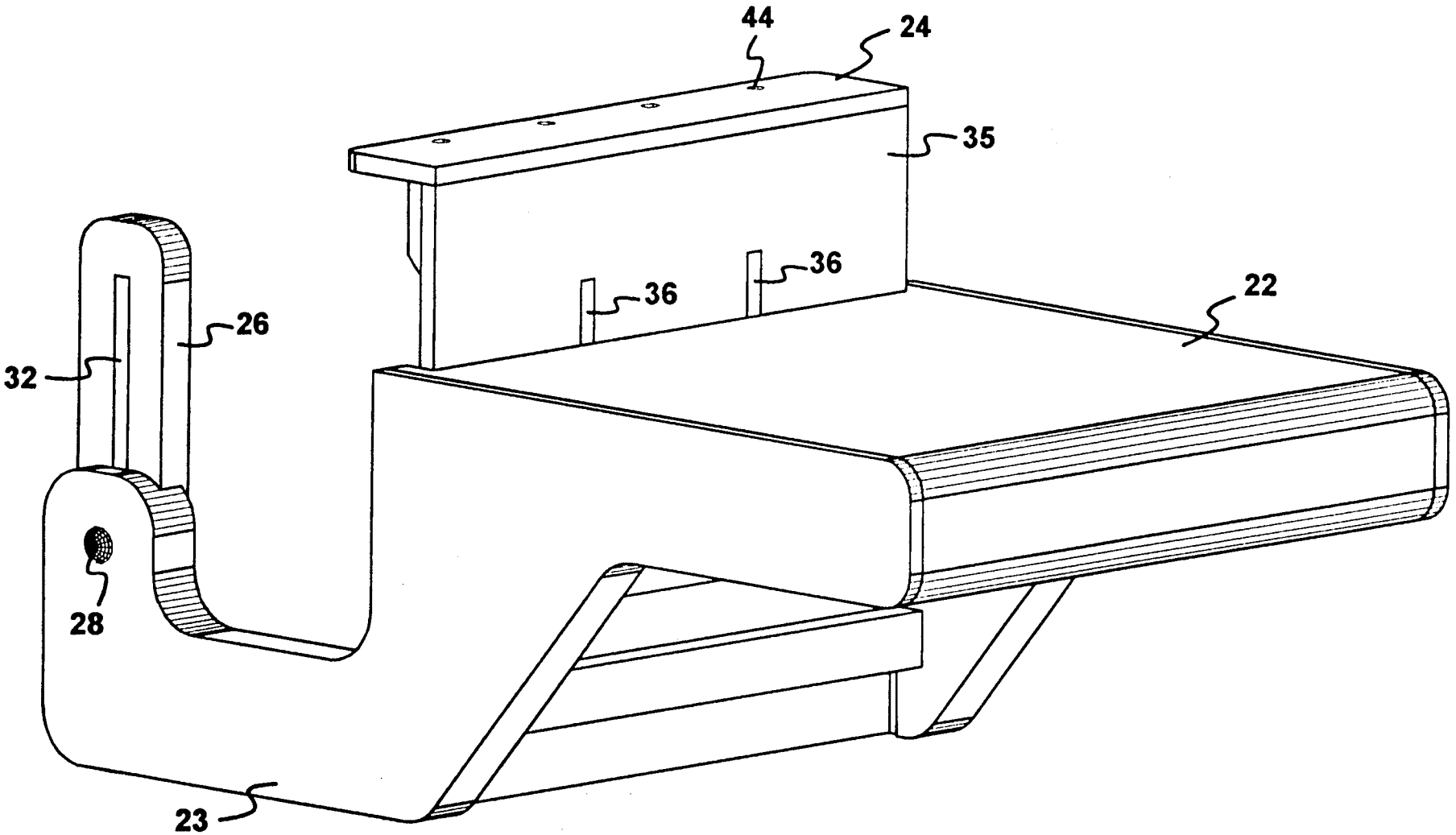
FIG. 2 is a perspective view of a mouse worksurface in accordance with the present invention.
Figure 3:
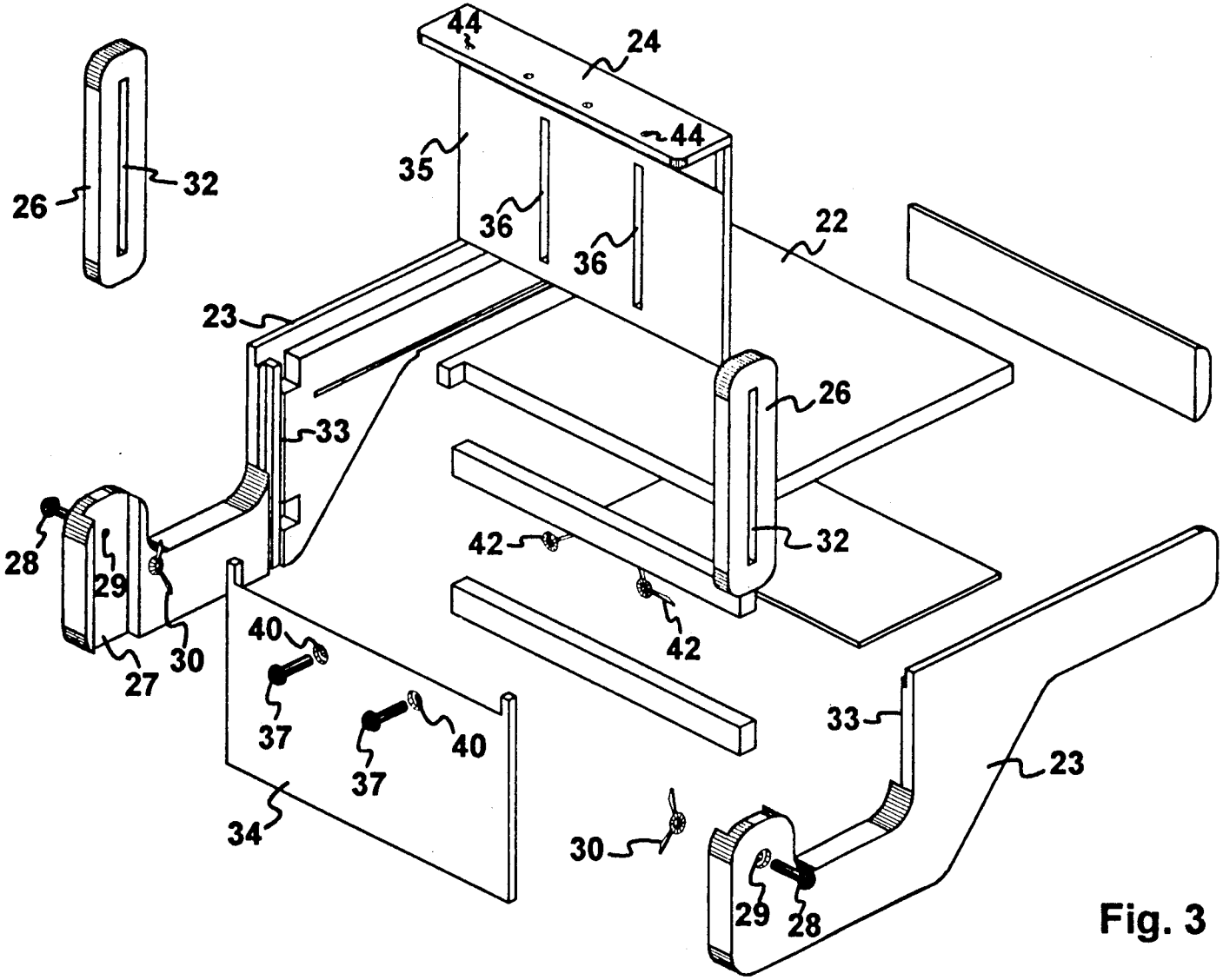
FIG. 3 is an exploded view of elements that may be used to form a mouse tray.

In reviewing FIGS. 2 and 3 it will be noted that first clamp element 24 is provided with a number of holes 44. Referring now to FIG. 1A it will be seen that these holes are provided to enable pins 19 to be placed in first clamp element 24 to allow the clamp element to be affixed to a vertical surface of the computer workarea This feature is useful where it is desired to mount the mouse worksurface 22 to a keyboard tray 21, or to a drawer front or drawer side. To mount the mouse worksurface to a computer workarea drawer, it is necessary to simply open the tray or drawer as far as necessary to allow the mouse tray assembly to be mounted on the opened keyboard tray 21 or drawer provision is made to allow many pins 19 to be mounted in first clamp element 24 to allow the mouse tray assembly to attach to trays or drawers that are narrower than the width of the mouse worksurface 22. Attaching the mouse tray assembly to a keyboard tray 21 as shown offers substantial ergonomic advantage to the user of the computer system. It allows the user to have a more comfortable posture when using a mouse with a computer having its keyboard in a keyboard tray. Without the mouse tray assembly, the operation of the mouse would have to take place on the desktop workarea 10 causing the user to reach forward, or pull the chair forward, thus putting the remaining hand on the keyboard in a very cramped and awkward to use position. By having the mouse worksurface 22 an equal distance from the user, a more natural posture can be maintained.

Referring to FIG. 2, a perspective view of a mouse worksurface in accordance with the present invention is shown. Slideably attached to mouse worksurface 22 is shown a first clamp element 24 which is used to clamp the mouse worksurface to a suitable surface of the computer workarea. Typically, the suitable surface would be the desktop that the computer is resting on. First clamp element 24 is slideably attached to mouse worksurface 22 to enable the mouse worksurface to be clamped on the desktop at varying levels to the desktop. Thus the mouse may be mounted lower than the surface of the desktop 10. This is particularly advantageous where it is desired to operate the mouse at a level below the desktop, for example, when the computer keyboard is at a level below the desktop sitting in a keyboard tray. Second clamp element 26 is preferably slideably mounted in a channel 27 formed in extensions to the mouse surface 22 most clearly shown in FIG. 3.

Referring now to FIG. 3 which shows an exploded view of the elements of a mouse tray in accordance with the present invention. The mouse worksurface 22 is coupled to extension arms 23 in which are formed channels 27 that are dimensioned to slideably engage second clamp elements 26. By providing channels 27 to retain the second clamp elements 26, the distance between first clamp element 24 and second clamp element 26 may be varied to allow the mouse worksurface 22 to be mounted on computer workareas of differing thicknesses. Any suitable table thickness may be firmly engaged using this type of clamping configuration. Once a desired position of second clamp element is found, it is set by tightening each mating bolt 28 and wing-nut 30. Each bolt 28 passes through a corresponding hole 29 provided in each extension arm 23 and also passes through slot 32 in each second clamp element 26. The bolt 28, extension arm 23 and slotted second clamp element 26 are all compressed together by turning wing-nut 32.

It will be noted that extension arm 23 is provided with a throat area 31, which is set well down from the horizontal surface of the mouse worksurface 22. This throat area 31 is provided to allow the mouse worksurface 22 to be positioned level to a desktop workarea. A sufficient throat offset or depth is needed to allow the mouse worksurface 22 to be level to a desktop even when the desktop has an outer edge trim extending down around the perimeter of the desktop.

As previously discussed with reference to FIG. 2, the mouse worksurface 22 may be offset below the computer workarea to which it is mounted. The offset is obtained by providing mouse worksurface 22 with an opposing pair of perpendicularly disposed channels 33 which are dimensioned to slideably receive a longitudinally rectangular tab 35 extending perpendicularly to the first clamp element 24. Thus the first clamp element 24 may slide in the channels 33 to various offsets from the mouse worksurface 22. Once a desired offset has been selected, the first clamp element is rigidly secured to the mouse worksurface to prevent any subsequent motion. The locking can be achieved by providing tab 35 with one or more slots 36 through which a corresponding bolt 37 can pass. The bolt 37 and tab 35 is fixed to mouse worksurface 22 by incorporating an anchor 34 in mouse worksurface 22 that is provided with holes 40 to physically correspond with slots 36 and through which the bolts 37 can pass. Once the first clamp element 24 is positioned at the desired offset, the bolt 37 secures the elements together by tightening corresponding wing-nuts 42.

Figure 4:
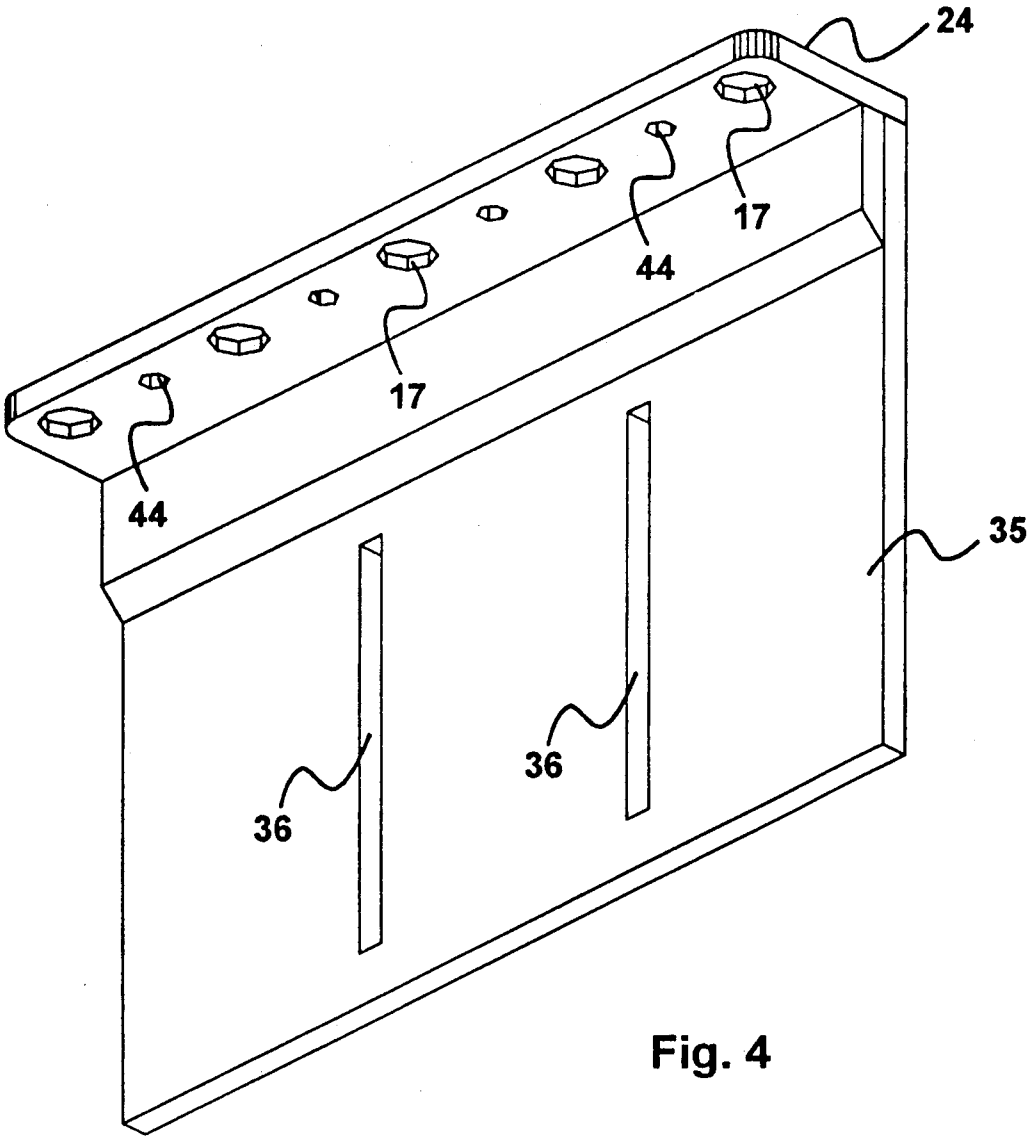
FIG. 4 is a perspective view detailing the first clamp element.

Referring now to FIG. 4, which is a perspective view detailing the first clamp element, the lower surface of the clamp element 24 is shown. This is the portion of the clamp element that contacts the workarea that the mouse tray assembly is to be mounted on. It is preferable to provide the contact area with at least one grip 17 made of rubber or some other suitable high friction material providing grips 17 increase the frictional contact between first clamp element 24 and the workarea preventing the mouse tray assembly from wandering or moving around when the mouse is being operated.

Figure 5A:
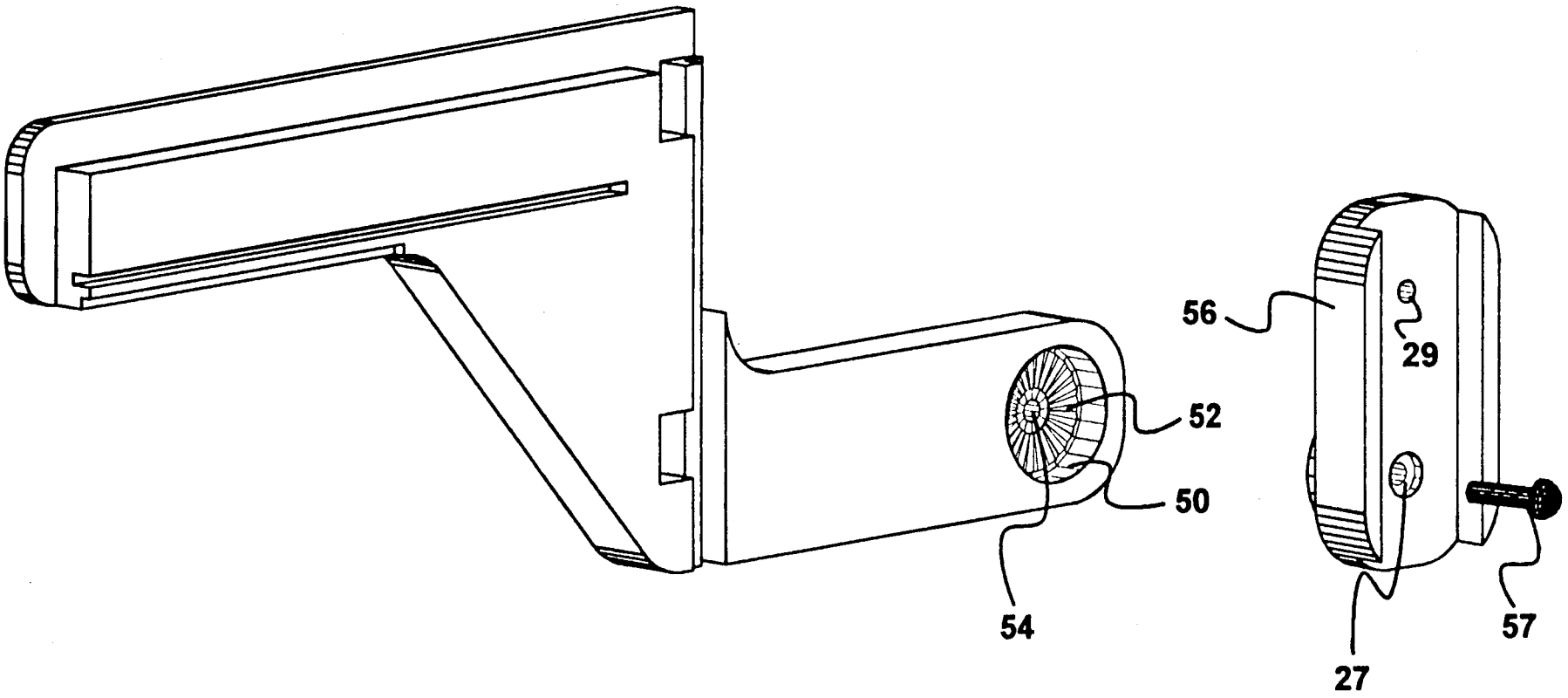
FIG. 5A is a perspective view detailing an alternate embodiment of the second clamp element.
Figure 5B:
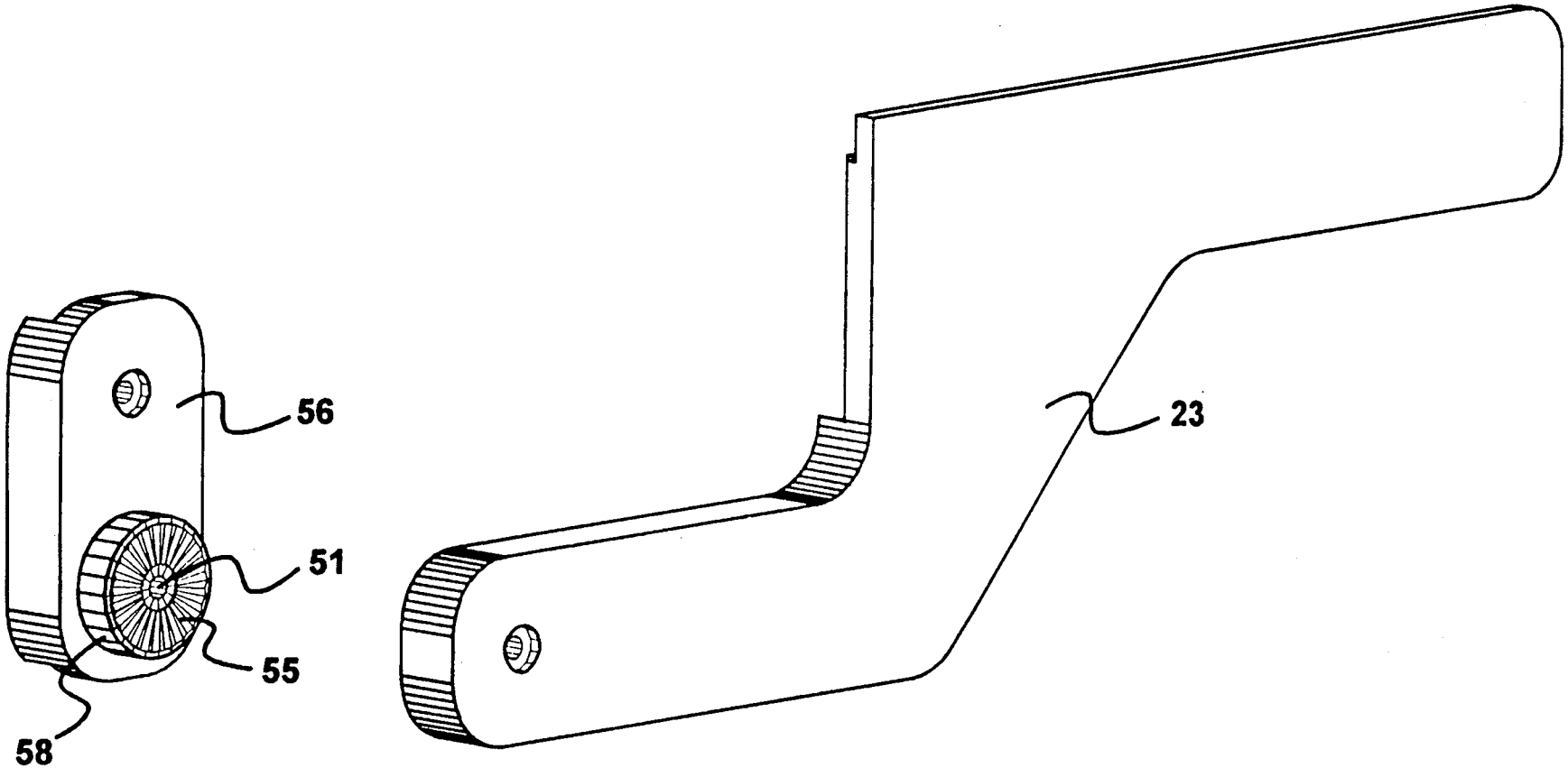
FIG. 5B is a perspective view detailing an alternate embodiment of the second clamp element from the opposite perspective of FIG. 5A.

Referring now to FIGS. 5A and 5B which show opposite perspective views detailing an alternate embodiment of the second clamp element. Looking at FIG. 5A, extension arm is provided with a cylindrical hole (concave cylinder) 50 having a plurality of radial indentations 52 extending uniformly around the bottom of the concave cylinder 50. A hole is provided in the bottom of the concave cylinder at the cylinder's axis for passing a fixing element, such as a bolt 57 therethrough. Second clamp element 56 is configured to rotatably attach to extension arm 23. Looking at FIG. 5B, second clamp element 56 is provided with a cylindrical extrusion (convex cylinder) 58 having a plurality of radial indentations 55 extending uniformly around the face of the convex cylinder 58. A hole 51 is provided through the body of the convex cylinder along the cylinder's axis for passing a fixing element, such as a bolt 57 therethrough. The diameters of the convex and concave cylinders are dimensioned to allow the concave cylinder 50 of extension arm 23 to rotatably receive the convex cylinder 58 of second clamping element 56. The radial indentations 55 of convex cylinder 58 are mirror images of the radial indentations 52 of concave cylinder 50. Therefore, when second clamping element 56 is position in extension arm 23, the second clamping element is constrained to rotating to discrete angles with respect to the extension arm depending on the fineness of the mating mirror image indentations. Once a desired angle is selected, the second clamping element can be fixed to remain at that angle by passing bolt 57 through the axial holes 51 and 54 and tightening a nut (not shown) to the end of the bolt. As may be appreciated from the foregoing discussion, it is equally easy to affix the second clamping element to the body of the mouse worksurface using this rotatably attaching arrangement, or the previously described slidably attaching configuration.

It will be noted that the second clamping element 26 has been shown as 2 individual pieces as most clearly seen in FIG. 3. A single u-shaped loop could be substituted for the two separate second clamping elements or, equally possible a single second clamping element slideably or rotatably attaching to the mouse worksurface 22 could be employed. Using these alternate embodiments of the second clamping element is not preferred as they limit the type of table tops and desktops that the tray in accordance with the present invention may be affixed to. For example, providing 2 separate second clamping elements allows the mouse tray to be affixed to the extreme corner of a table, straddling the leg post. A single second clamping element, whether a u-shaped loop or single longitudinal element would not work in this situation.

To manufacture a mouse worksurface as described herein, it is preferable to use plastic injection moulding techniques using as few separate elements as are necessary to minimize the cost yet provide a useful worksurface that functions in accordance with the description contained herein. For example, although the mouse worksurface 22, extension arms 23 and anchor 34 were shown as separate pieces for the purposes of illustrating and describing the invention, these pieces may all be incorporated into a single mouse worksurface element. It will be noted, however, that for the purposes of packaging the mouse tray assembly for shipment and distribution, the least possible physical space is most desirable. Providing several substantially flat pieces that can be readily fitted or snapped together by the purchaser yet shipped in a compact form is desirable as well.

While the invention has been described with reference to its use as a mouse worksurface, it will be appreciated that it could quite easily be dimensioned to support a computer keyboard as well. Using a configuration as described herein as a keyboard tray offers a great advantage over the tray disclosed by McIntosh referred to earlier in that it requires no mounting hardware to attach the tray to the desktop. Thus a keyboard tray as described herein could be readily affixed to any suitable desktop without any tools needed to effect the mounting and without damaging or defacing the desktop itself.

Now that the invention has been illustrated and described, numerous substitutions and modifications will become apparent to those skilled in the art all of which are within the spirit and scope of the invention which is defined in the appended claims.

I claim:

1. Apparatus to provide a mountable worksurface for the operation of a computer mouse adapted to be attached to a computer workarea comprising a first clamp element having a tab slidably attached to a substantially flat rectangular mouse worksurface and locking means to lock said first clamp element at a predetermined position in relation to said mouse worksurface whereby said first clamp element is adapted to clamp the upper portion of a computer workarea with said mouse worksurface positioned horizontally at a selected off-set to the computer workarea; a pair of extension arms attached to and extending below opposing sides of said mouse worksurface, adjacent to the side incorporating said first clamp element; each extension arm provided with a channel for slidably receiving a second clamp element, said second clamp element adapted to be positioned to engage the underside of said computer workarea inward from the edge thereof, and locking means to lock each said second clamp element to its corresponding extension arm at a predetermined position whereby said computer mouse worksurface will be rigidly attached to said computer workarea providing a mouse worksurface positioned above or below said computer workarea.

2. Apparatus to provide a mountable worksurface for the operation of a computer mouse adapted to be attached to a computer workarea as claimed in claim 1 wherein each said extension arms are provided with a concave cylinder depression having radial indentations at the bottom thereof to rotatably receive an second clamp mating channel element with a corresponding convex cylinder protrusion having radial indentations at the top thereof on the opposite facing side from said second clamp mating channel whereby said second clamp element is slidably attached to said second clamp mating channel element and said second clamp mating channel element is rotatably attached to said extension arm and said locking means is used to lock said second clamp element at a predetermined rotation and position in relation to said mouse worksurface.

3. Apparatus to provide a mountable worksurface for the operation of a computer mouse adapted to be attached to a computer workarea as claimed in claim 1 wherein said tab of said first clamp element is provided with at least one slot extending longitudinally along said tab adapted to allow said locking means to pass through said tab and lock said first clamp element to said mouse worksurface.

4. Apparatus to provide a mountable worksurface for the operation of a computer mouse adapted to be attached to a computer workarea as claimed in claim 1 wherein said first clamp element is provided with a frictional grip on the underside thereof to frictionally engage the upper surface of said computer workarea.

5. Apparatus to provide a mountable worksurface for the operation of a computer mouse adapted to be attached to a computer workarea as claimed in claim 2 wherein said first clamp element is provided with a frictional grip on the underside thereof to frictionally engage the upper surface of said computer workarea.

6. Apparatus to provide a mountable worksurface for the operation of a computer mouse adapted to be attached to a computer workarea as claimed in claim 1 wherein said first clamp element is provided with at least one hole adapted to receive a mating pin therethru to engage a vertical extension of said computer workarea.

7. Apparatus to provide a mountable worksurface for the operation of a computer mouse adapted to be attached to a computer workarea as claimed in claim 2 wherein said first clamp element is provided with at least one hole adapted to receive a mating pin therethru to engage a vertical extension of said computer workarea.

* * * * *